US008891802B2

(12) United States Patent
Infanti

(10) Patent No.: US 8,891,802 B2
(45) Date of Patent: Nov. 18, 2014

(54) ENCLOSURE AND ENCLOSURE SYSTEM FOR A SPEAKER OF AN ELECTRONIC DEVICE

(75) Inventor: James Infanti, Waterloo (CA)

(73) Assignee: BlackBerry Limited, Waterloo, Ontario (CA)

( * ) Notice: Subject to any disclaimer, the term of this patent is extended or adjusted under 35 U.S.C. 154(b) by 1439 days.

(21) Appl. No.: 12/114,102

(22) Filed: May 2, 2008

(65) Prior Publication Data

US 2009/0274336 A1 Nov. 5, 2009

(51) Int. Cl.
*H04R 1/02* (2006.01)
*H04R 1/28* (2006.01)

(52) U.S. Cl.
CPC ..... *H04R 1/2811* (2013.01); *H04R 2499/11* (2013.01)
USPC ..... 381/386

(58) Field of Classification Search
USPC ..... 381/64, 189, 386
See application file for complete search history.

(56) References Cited

U.S. PATENT DOCUMENTS

| | | | | |
|---|---|---|---|---|
| 5,012,889 | A | 5/1991 | Rodgers | |
| 5,111,905 | A | 5/1992 | Rodgers | |
| 5,147,237 | A | 9/1992 | Kwan et al. | |
| 5,661,271 | A | 8/1997 | Moser | |
| 5,680,465 | A | 10/1997 | Boyden | |
| 5,682,290 | A | 10/1997 | Markow et al. | |
| 5,953,414 | A * | 9/1999 | Abraham et al. | 379/433.02 |
| 6,058,315 | A | 5/2000 | Clark | |
| 6,062,338 | A | 5/2000 | Thompson | |
| 6,081,421 | A | 6/2000 | Markow et al. | |
| 6,134,336 | A | 10/2000 | Clark | |
| 6,292,573 | B1 | 9/2001 | Zurek et al. | |
| 6,321,070 | B1 | 11/2001 | Clark et al. | |
| 6,636,750 | B1 | 10/2003 | Zurek et al. | |
| 6,785,395 | B1 | 8/2004 | Arneson et al. | |
| 6,788,793 | B2 | 9/2004 | Tanemura et al. | |
| 6,834,744 | B2 | 12/2004 | Toki | |
| 6,836,676 | B2 | 12/2004 | Lloyd et al. | |
| 7,272,236 | B2 | 9/2007 | Nicholson et al. | |
| 7,353,041 | B2 * | 4/2008 | Zhu et al. | 455/550.1 |
| 7,565,178 | B1 * | 7/2009 | Sitachitt et al. | 455/569.1 |
| 7,797,025 | B2 * | 9/2010 | Hawker et al. | 455/575.1 |
| 2001/0040970 | A1 | 11/2001 | Dage | |
| 2002/0055374 | A1 | 5/2002 | Rivera | |
| 2002/0153193 | A1 * | 10/2002 | Toki | 181/148 |

(Continued)

FOREIGN PATENT DOCUMENTS

| | | | |
|---|---|---|---|
| EP | 0909077 | A2 | 4/1999 |
| EP | 1396983 | A1 | 3/2004 |

(Continued)

*Primary Examiner* — Fernando L Toledo
*Assistant Examiner* — Neil Prasad
(74) *Attorney, Agent, or Firm* — McCarthy Tétrault LLP

(57) ABSTRACT

The disclosure relates to a system for adjusting a response signal of a transducer of an electronic device is provided. The system comprises: a substrate, such as a printed circuit board (PCB), having a first side and a second side; a transducer making an electrical connection with the first side of the PCB; and an enclosure mounted on the second side of the PCB. The enclosure defines a volume by an interior space of the enclosure and the second side of the PCB. In the system, the PCB, the transducer and the enclosure are contained within a housing for the device; and the transducer is in communication with the volume.

18 Claims, 11 Drawing Sheets

(56) References Cited

U.S. PATENT DOCUMENTS

| | | | | |
|---|---|---|---|---|
| 2002/0187758 | A1 | 12/2002 | Ylitalo et al. | |
| 2003/0096632 | A1 | 5/2003 | Kim et al. | |
| 2004/0162025 | A1 | 8/2004 | Plummer | |
| 2004/0165745 | A1 | 8/2004 | Nicholson et al. | |
| 2004/0253977 | A1 | 12/2004 | Matsumoto et al. | |
| 2005/0266892 | A1 | 12/2005 | Schrack | |
| 2006/0124382 | A1 | 6/2006 | Bhavnani | |
| 2006/0198547 | A1 | 9/2006 | Hampton et al. | |
| 2006/0256991 | A1 | 11/2006 | Oxford | |
| 2007/0135185 | A1 | 6/2007 | Dvorak et al. | |
| 2007/0189554 | A1 | 8/2007 | Innis et al. | |
| 2008/0144879 | A1 * | 6/2008 | Yang et al. | 381/386 |
| 2009/0129623 | A1 * | 5/2009 | Weckstrom et al. | 381/386 |

FOREIGN PATENT DOCUMENTS

| | | | |
|---|---|---|---|
| EP | 1489681 | A1 | 12/2004 |
| EP | 0909077 | A3 | 5/2006 |
| EP | 1758348 | A2 | 2/2007 |
| WO | WO 03/077507 | A1 | 9/2003 |

* cited by examiner

ENCLOSURE AND ENCLOSURE SYSTEM FOR A SPEAKER OF AN ELECTRONIC DEVICE

The disclosure herein describes an enclosure and an enclosure system for a transducer of an electronic device. In particular, the disclosure relates to an enclosure for a speaker that modifies acoustic and/or performance characteristics of the speaker.

BACKGROUND

Current wireless handheld mobile communication devices perform a variety of functions to enable mobile users to stay current with information. A speaker is a transducer which is commonly provided with a device as an audio output device. Certain acoustic properties of such a speaker can be enhanced with enclosures. Within the housing of an electronic device, especially in a portable device, where there may be constraints as to the size and location of the enclosure.

BRIEF DESCRIPTION OF THE DRAWINGS

Details on the disclosure will now be described, by way of example only, with reference to the accompanying drawings, in which.

DETAILED DESCRIPTION OF AN EMBODIMENT

Figure 1:
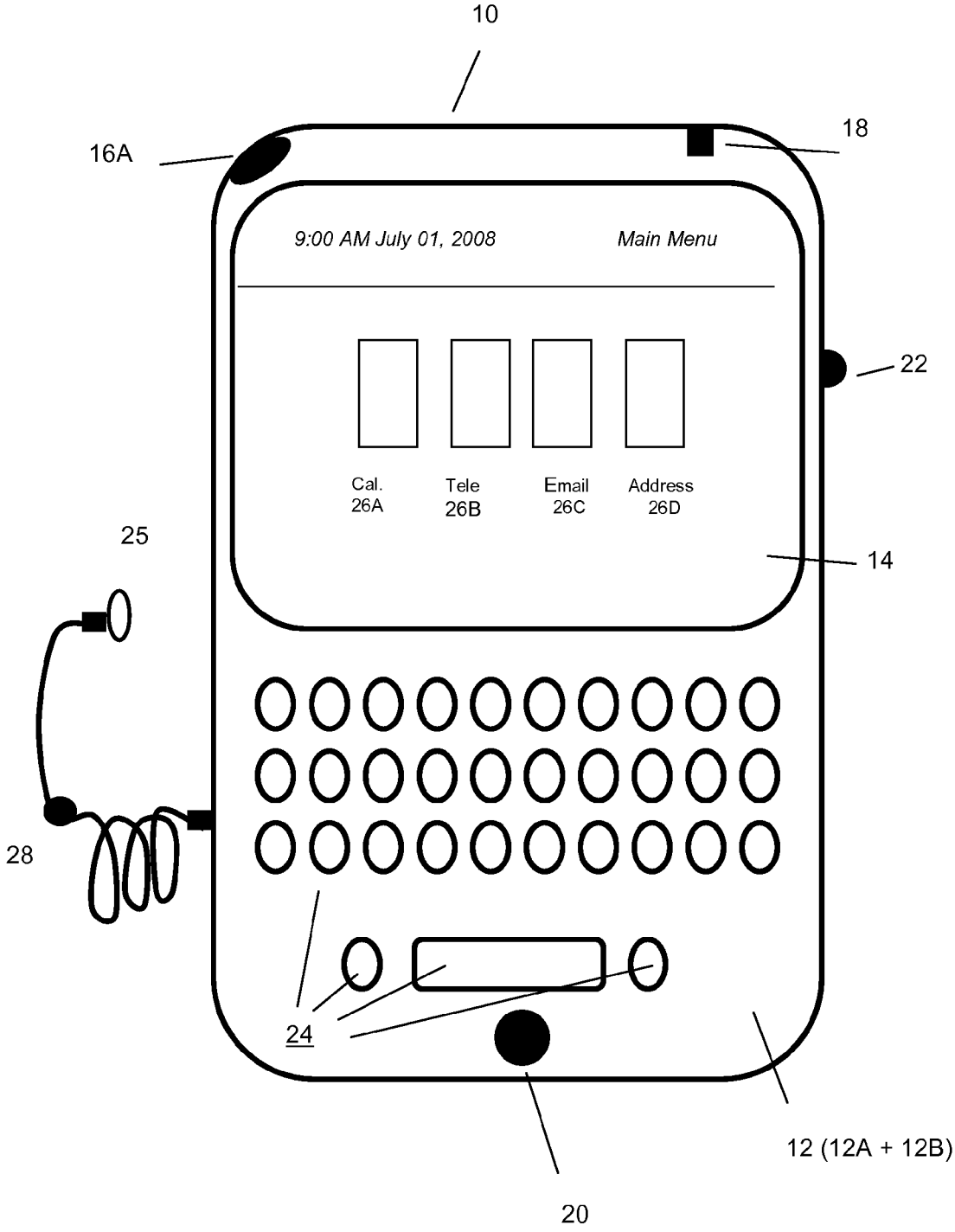
FIG. 1 is a front plan view of an electronic device with its housing having an internal back speaker and an enclosure in accordance with an embodiment.

The description which follows and the embodiments described therein are provided by way of illustration of an example or examples of particular embodiments of the principles of the present disclosure. These examples are provided for the purposes of explanation and not limitation of those principles and of the disclosure. In the description which follows, like parts are marked throughout the specification and the drawings with the same respective reference numerals.

In a first aspect, a system for adjusting a response signal of a transducer of an electronic device is provided. The system comprises: a substrate, such as printed circuit board (PCB), having a first side and a second side; a transducer mounted to the first side of the substrate; and an enclosure mounted about the second side of the substrate, where the enclosure defines a first volume by an interior space of the enclosure and the second side of the substrate. In the system, the substrate, transducer and enclosure may be contained within a housing for the device, and the transducer may be in communication with the first volume.

In the system, the transducer may be a speaker; the substrate may include a first aperture located about a mounting location for the speaker, where the first aperture provides an opening from the first side to the second side of the substrate; the enclosure may be a radio frequency (RF) shield for one or more components (or devices) mounted on the second side of the substrate, where the enclosure is affixed to the substrate. In the system, the first aperture may connect the first volume to the speaker.

The system may further comprise: a gasket located on a top of the RF shield; and a second aperture on a top surface of the RF shield. The housing, the gasket and the top of the RF shield may define a second volume connected to the first volume by the second aperture.

In the system, the second volume may be between 0.05 $cm^3$ and 0.75 $cm^3$.

The system may further comprise: a gasket located on a top of the RF shield; a cap for the gasket; and a second aperture on a top surface of the RF shield. In the system, the cap, gasket and top of the RF shield may define a second volume connected to the first volume by the second aperture.

In the system, the housing may further comprise a mounting region extending from an internal surface to hold the speaker.

In the system, the speaker may be a back speaker projecting sound from a back side of the device.

In the system, the first volume may be between 0.3 $cm^3$ and 5.0 $cm^3$.

In the system, the first aperture may have a cross-sectional area of between 0.1 $mm^2$ and 20 $mm^2$ on the substrate.

The system may further comprise a tube inserted into the first aperture.

In the system the transducer may be a speaker; the substrate may include a first aperture located about a mounting location for the speaker, where the first aperture provides an opening from the first side to the second side of the substrate; the enclosure may be an enclosure for an antenna for the device, where the enclosure is located about the second side of the substrate; and the first aperture connects the first volume to the speaker.

In a second aspect, an electronic device is provided. The device comprises: a housing; a PCB having a first side and a second side; a first transducer making an electrical connection with the first side of the substrate; and an enclosure mounted about the second side of the substrate within the housing. The enclosure defines a first volume by an interior space of the enclosure and the second side of the substrate; the substrate, transducer and enclosure are contained within the housing.

In the device, the first transducer may be a speaker; the substrate may include a first aperture located about a mounting location for the speaker, where the first aperture provides an opening from the first side to the second side of the substrate; the enclosure may be a RF shield for components mounted on the second side of the substrate; and the first aperture may connect the first volume to a back side of the speaker.

The device may further comprise a second transducer and the speaker may be a back speaker projecting sound from a back side of the device.

The device may further comprise: a gasket located on a top of the RF shield; and a second aperture on a top surface of the RF shield. Further, the housing, gasket and top of the RF shield may define a second volume connected to the first volume by the second aperture.

In the device, the housing may further comprise a mounting region extending from an internal surface to hold the speaker.

In the device, the first volume may be between 0.3 $cm^3$ and 5.0 $cm^3$.

In the device, the first aperture may have a cross-sectional area of between 0.1 $mm^2$ and 20 $mm^2$ on the substrate.

In another aspect, a method is provided. The method comprises: forming an aperture in a substrate, the substrate having a first side and a second side; mounting a transducer to the first side of the substrate proximate to the aperture; and an enclosure to the second side of the substrate such that the enclosure covers at least a portion of the aperture. In the method, the enclosure defines a first volume by an interior space of the enclosure and the second side of the substrate, and the transducer is in air communication with the first volume.

In other aspects, various sets and subsets of the above noted aspects are provided.

Referring to FIG. 1, an electronic device for receiving electronic communications in accordance with an embodiment of the disclosure is indicated generally at 10. In the present embodiment, electronic device 10 is based on a computing platform having exemplary functionality of an enhanced personal digital assistant such as cellphone, e-mail, photographic and media playing features. It is, however, to be understood that electronic device 10 can be based on construction design and functionality of other electronic devices, such as smart telephones, desktop computers pagers or laptops having telephony equipment. In a present embodiment, electronic device 10 includes a housing 12 comprising front housing 12A and rear housing 12B (not shown). There may be one or more components in device 10, including, for example any of: a display 14 (which may be a liquid crystal display or LCD), speaker 16A, a light emitting diode (LED) indicator 18, a trackball 20, a trackwheel (not shown), an ESC ("escape") key 22, keys 24, touchpad (not shown), a telephone headset comprised of an ear bud 25 and a microphone 28. Trackball 20 and ESC key 22 can be inwardly depressed as a means to provide additional input signals to device 10. Other components may also be provided in device 10.

Housing 12 may be made from a plastic material, such as polycarbonate. Its components may be formed via an injection molding process. It may have coatings, such as metalicized paints or coatings provided to interior or exterior surfaces or regions. Housing 12 can be made from any suitable material (such as metal) as will occur to those of skill in the art and may be suitably formed to house and hold all components of device 10.

Device 10 is operable to conduct wireless telephone calls, using any known wireless phone system such as a Global System for Mobile Communications ("GSM") system, Code Division Multiple Access ("CDMA") system, Cellular Digital Packet Data ("CDPD") system and Time Division Multiple Access ("TDMA") system. Other wireless phone systems can include Bluetooth and the many forms of 802.11 wireless broadband, like 802.11a, 802.11b, 802.11g, etc. that support voice. Other embodiments include Voice over IP (VoIP) type streaming data communications that can simulate circuit switched phone calls. Ear bud 25 can be used to listen to phone calls and other sound messages and microphone 28 can be used to speak into and input sound messages to device 10.

Various applications are provided on device 10, including email, telephone, calendar and address book applications. A graphical user interface (GUI) providing an interface to allow entries of commands to activate these applications is provided on display 14 through a series of icons 26. Shown are calendar icon 26A, telephone icon 26B, email icon 26C and address book icon 26D. Such applications can be selected and activated using the touchpad and/or the trackball 20. Further detail on selected applications is provided below.

Keys 24 provide one or more distinct, fixed input keys for device 10. Typically, they may include at least part of keys in an alphanumeric character set. A touchpad may be provided and configured to provide an additional set of "keys" (or input areas) to augment keys 24.

Figure 2:
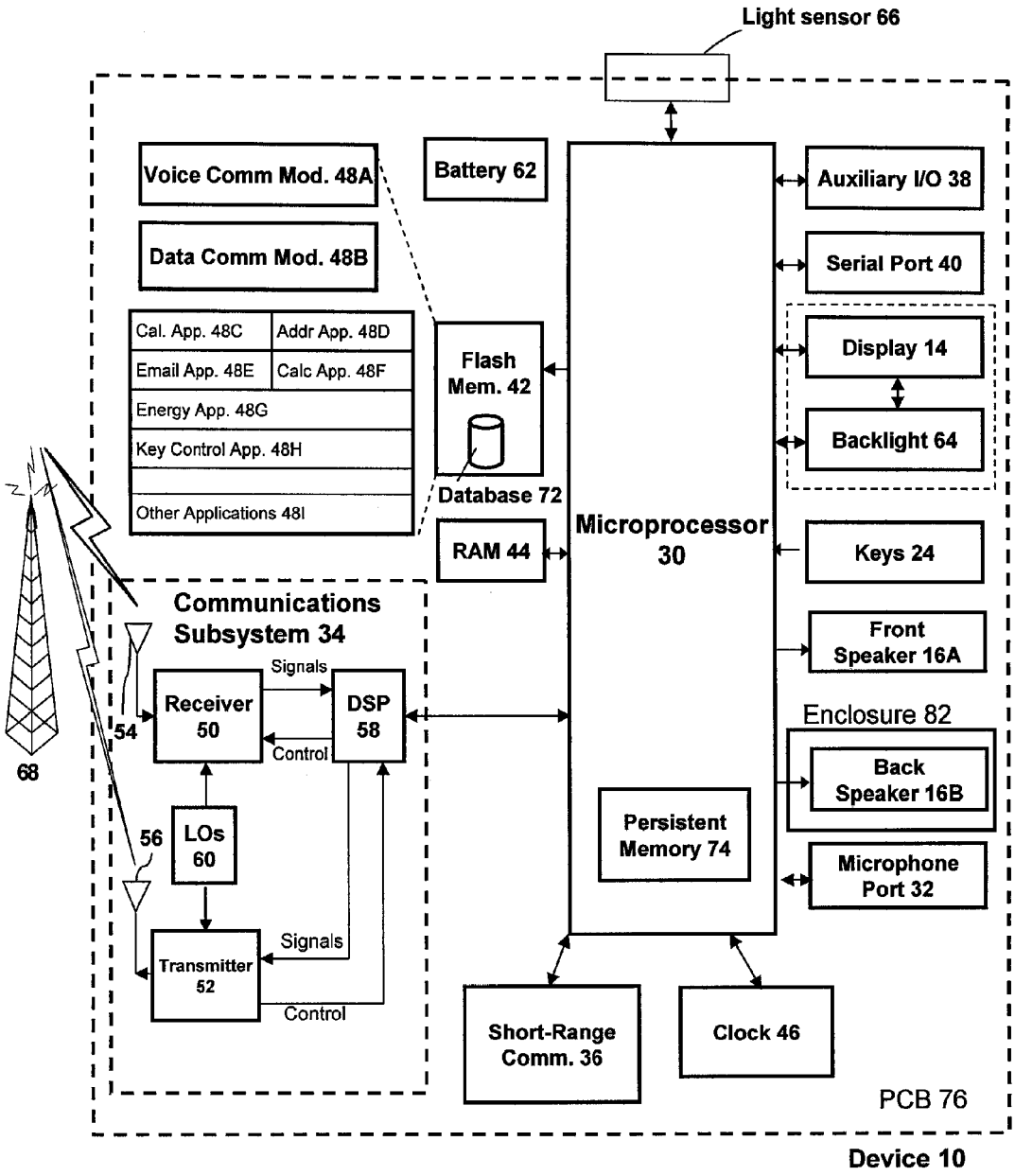
FIG. 2 is a block diagram of internal components of the device of FIG. 1 including the back speaker and the enclosure.

Referring to FIG. 2, functional elements, modules, components and systems of device 10 are provided. The functional elements are generally electronic or electro-mechanical devices mounted within a housing. Many devices are also mounted on an internal substrate, such as a printed circuit board (PCB). A substrate is any generally planar rigid platform. In one embodiment, PCB 76 is a substrate for mounting and supporting the internal components on both of its top and bottom sides and provides some electrical circuitry for the devices, as defined by etchings within the layers of plastic and copper. As such, components can be more densely packed thereon, thereby reducing the size of PCB 76. PCB 76 is securely mountable within housing 12, typically via screws. PCB 76 is a generally planar sandwich of layers of plastic (or FR4) and copper. PCB 76 allows components to be placed on both of its sides ("top" and "bottom"). Some components may require isolation or sufficient physical separation from other components. For example, radio frequency (RF) signals from antenna may interfere with the operation of other devices. Shielding may be provided. Further details on these components and layouts are provided below.

Microprocessor 30 is provided to control and receive almost all data, transmissions, inputs and outputs related to device 10. Microprocessor 30 is shown schematically as coupled to keys 24, touchpad, display 14 and other internal devices. Microprocessor 30 controls the operation of display 14, as well as the overall operation of device 10, in response to actuation of keys 24 and keys on touchpad. Exemplary microprocessors for microprocessor 30 include microprocessors in the Data 950 (trade-mark) series, the 6200 series and the PXA900 series, all available at one time from Intel Corporation.

In addition to microprocessor 30, other internal devices of device 10 include: a communication subsystem 34; a short-range communication subsystem 36; touchpad; and display 14; other input/output devices including a set of auxiliary I/O devices through port 38, a serial port 40, a front speaker 16A, a back speaker 16B, and a microphone port 32 for microphone 28; and memory devices including a flash memory 42 (which provides persistent storage of data) and random access memory (RAM) 44; persistent memory 74; clock 46 and other device subsystems (not shown). There may be more than one front speaker 16A and/or back speaker 16B. Back speaker 16B may be provided on the back side of housing 12B, but may also be provide on other locations in device 10, such as on its side or even on its front in its housing 12.

Persistent memory 74 may be a separate memory system to flash memory 42 and may be incorporated into a component in device 10, such as in microprocessor 30. Additionally or alternatively, memory 74 may removable from device 10 (e.g. such as a SD memory card), whereas flash memory 42 may be permanently connected to device 10. Device 10 is may be a two-way radio frequency (RF) communication device having voice and data communication capabilities. In addition, device 10 may have the capability to communicate with other computer systems via the Internet. One or both of speakers 16A and 16B may be selected and tuned to operate in an acoustic frequency range suitable for telephone voice transmissions, where a focus is typically placed on response characteristics of signals between about 300 Hz and about 3,300 Hz. Other ranges can be focused on depending on particular acoustic performance goals of the speaker(s).

Operating system software executed by microprocessor 30 is preferably stored in a computer readable medium, such as flash memory 42, but may be stored in other types of memory devices (not shown), such as read only memory (ROM) or similar storage element. In addition, system software, specific device applications, or parts thereof, may be temporarily loaded into a volatile storage medium, such as RAM 44. Communication signals received by the mobile device may also be stored to RAM 44.

Microprocessor 30, in addition to its operating system functions, enables execution of software applications on device 10. A set of software applications 48A-I that control basic device operations, such as voice communication module 48A and data communication module 48B, may be installed on device 10 during manufacture or downloaded thereafter.

Communication functions, including data and voice communications, are performed through communication subsystem 34 and short-range communication subsystem 36. Collectively, subsystem 34 and subsystem 36 provide a signal-level interface for all communication technologies processed by device 10. Various other applications 48 provide the operational controls to further process and log the communications. Communication subsystem 34 includes receiver 50, transmitter 52 and one or more antennas, illustrated as receive antenna 54 and transmit antenna 56. In addition, communication subsystem 34 also includes processing module, such as digital signal processor (DSP) 58 and local oscillators (LOs) 60. The specific design and implementation of communication subsystem 34 is dependent upon the communication network in which device 10 is intended to operate. For example, communication subsystem 34 of device 10 may be designed to work with one or more of a Mobitex (trade-mark) Radio Network ("Mobitex") and the DataTAC (trade-mark) Radio Network ("DataTAC"). Voice-centric technologies for cellular device 10 include Personal Communication Systems (PCS) networks like Global System for Mobile Communications (GSM) and Time Division Multiple Access (TDMA) systems. Certain networks provide multiple systems. For example, dual-mode wireless networks include Code Division Multiple Access (CDMA) networks, General Packet Radio Service (GPRS) networks, and so-called third-generation (3G) networks, such as Enhanced Data rates for Global Evolution (EDGE) and Universal Mobile Telecommunications Systems (UMTS). Other network communication technologies that may be employed include, for example, Ultra Mobile Broadband (UMB), Evolution-Data Optimized (EV-DO), and High Speed Packet Access (HSPA), etc.

In addition to processing communication signals, DSP 58 provides control of receiver 50 and transmitter 52. For example, gains applied to communication signals in receiver 50 and transmitter 52 may be adaptively controlled through automatic gain control algorithms implemented in DSP 58.

In a data communication mode a received signal, such as a text message or web page download, is processed by the communication subsystem 34 and is provided as an input to microprocessor 30. The received signal is then further processed by microprocessor 30 which can then generate an output to display 14 or to an auxiliary I/O port 38. A user may also compose data items, such as e-mail messages, using keys 24, trackball 20, or a thumbwheel (not shown), and/or some other auxiliary I/O device connected to port 38, such as a keypad, a rocker key, a separate thumbwheel or some other input device. The composed data items may then be transmitted over communication network 68 via communication subsystem 34.

In a voice communication mode, overall operation of device 10 is substantially similar to the data communication mode, except that received signals are output to speaker 16, and signals for transmission are generated by microphone 28. Alternative voice or audio I/O subsystems, such as a voice message recording subsystem, may also be implemented on device 10.

Audio output from device 10 may be provided to one or more of speaker 16A, 16B and/or ear bud 25. Different acoustic signals may be provided to each speaker to tailor the output to each speaker.

Short-range communication subsystem 36 enables communication between device 10 and other proximate systems or devices, which need not necessarily be similar devices. For example, the short-range communication subsystem may include an infrared device and associated circuits and components, or a Bluetooth (trade-mark) communication module to provide for communication with similarly-enabled systems and devices.

Powering electronics of the mobile handheld communication device is power source 62 (shown in FIG. 2 as "battery"). The power source 62 includes one or more batteries. The power source 62 may be a single battery pack, especially a rechargeable battery pack. A power switch (not shown) provides an "on/off" switch for device 10. Upon activation of the power switch an application 48 is initiated to turn on device 10. Upon deactivation of the power switch, an application 48 is initiated to turn off device 10. Power to device 10 may also be controlled by other devices and by internal software applications. Additional supplementary power may be provided by additional circuits (which may be referred to as modules) and components in device 10.

A touchpad is an input device, which may be provided in device 10. A touchpad provides a surface on which a user is meant to glide his finger, in order to provide input signals to move a cursor generated on a graphical user interface (GUI). A touchpad has a series of sensors located underneath the surface to sense a capacitance of the finger or capacitance between sensors.

Display 14 has backlight system 64 to assist in the viewing of display 14, especially under low-light conditions. A backlight system is typically present in a LCD. A typical backlight system comprises a lighting source, such as a series of LEDs or a lamp located behind the LCD panel of the display and a controller to control activation of the lighting source. The lamp may be fluorescent, incandescent, electroluminescent or any other suitable light source known to a person of skill in the art. As the lighting sources are illuminated, their light shines through the LCD panel providing backlight to the display. The intensity of the backlight level may be controlled by the controller by selectively activating a selected number of lighting sources (e.g. one, several or all LEDs) or by selectively controlling the activation duty cycle of the activated lighting sources (e.g. a duty cycle anywhere between 0% and 100% may be used).

To assist with one method of adjusting the backlight level, light sensor 66 is provided on device 10. Sensor 66 is a light sensitive device which converts detected light levels into an electrical signal, such as a voltage or a current. It may be located anywhere on device 10, having considerations for aesthetics and operation characteristics of sensor 66. In one embodiment, an opening for light to be received by sensor 66 is located on the front cover of the housing of device 10 to reduce the possibility of blockage of the opening. In other embodiments, multiple sensors 66 may be provided and the software may provide different emphasis on signals provided from different sensors 66. The signal(s) provided by sensor(s) 66 can be used by a circuit in device 10 to determine when device 10 is in a well-lit, dimly lit or moderately-lit environment. This information can then be used to control backlight levels for display 14. It will be appreciated that a number of discrete ambient lighting levels may be recognized by sensor (s) 66. Progressions between levels may or may not be separated by a constant change in lighting intensity. In some embodiments, LED indicator 18 may be also used as a light sensor.

Now, brief descriptions are provided on the applications 48 stored and executed in device 10. Voice communication module 48A and data communication module 48B have been mentioned previously. Voice communication module 48A handles voice-based communication such as telephone communication, and data communication module 48B handles data-based communication such as e-mail. In some embodiments, one or more communication processing functions may be shared between modules 48A and 48B. Additional applications include calendar 48C which tracks appointments and other status matters relating to the user and device 10. Calendar 48C is activated by activation of calendar icon 26A on display 14. It provides a daily/weekly/month electronic schedule of appointments, meetings and events entered by the user. Calendar 48C tracks time and day data for device 10 using microprocessor 30 and internal clock 46. The schedule contains data relating to the current accessibility of the user. For example it can indicate when the user is busy, not busy, available or not available. In use, calendar 48C generates input screens on display 14 prompting the user to input scheduled events. Alternatively, notification for scheduled events could be received via an encoded signal in a received communication, such as an e-mail, SMS message or voicemail message. Once the data relating to the event is entered, calendar 48C stores processes information relating to the event; generates data relating to the event; and stores the data in memory in device 10.

Address book 48D enables device 10 to store contact information for persons and organizations. Address book 48D is activated by activation of address book icon 26D on display 14. Names, addresses, telephone numbers, e-mail addresses, cellphone numbers and other contact information is stored. The data can be entered through keys 24 and touchpad and is stored in an accessible database in non-volatile memory, such as persistent storage 74 or flash memory 42 or any electronic storage provided in device 10.

Email application 48E provides modules to allow user of device 10 to generate email messages on device 10 and send them to their addressees. Application 48E also provides a GUI which provides a historical list of emails received, drafted, saved and sent. Text for emails can be entered. Email application 48E is activated by activation of email icon 26C on display 14.

Calculator application 48F provides modules to allow user of device 10 to create and process arithmetic calculations and display the results through a GUI.

Database 72 is provided to store data and records for applications 48 and other modules and processes. Database 72 may be provided in flash memory 42 or in another data storage element.

With some features of device 10 described above, further detail is provided on specific aspects of embodiments. An embodiment provides an electronic device, such as a portable electronic communication device that has a transducer, such as a speaker, on its back side of its housing. This speaker may or may not be the primary speaker of the device. The speaker may be oriented on the back side of the housing so that it is exposed to some ambient air when the back side of the housing is resting on a flat surface, such as a table.

In order to change and/or tune response characteristics and/or acoustic properties of the transducer, one or more (air) volume enclosures may be provided for it. When the transducer is a speaker, the enclosure(s) may be used to tune an acoustic response of the speaker. For example, it may be used to reduce back-wave noise associated with the speaker and/or to tune a resonant frequency for the speaker. An embodiment may utilize enclosed volumes provided by other components in the device to define the enclosure. For example, a cap or shield or container may provide the volume for the enclosure. This may assist in addressing space constraints within the interior of device 10. Additional enclosures may be provided, such as separate dedicated enclosures, space permitting. One aspect provides an enclosure for the back speaker on the opposite side of the PCB on which it is mounted. The enclosure may be located about the opposite side of the PCB from which the speaker is mounted. In one embodiment, being "about" the PCB refers to an enclosure that is not affixed to the PCB. For example, it may be mounted within a space about the PCB, being secured to the housing. In another embodiment, being "about" the PCB refers to an enclosure (or a part thereof) that is affixed to the PCB. An aperture in the PCB about the speaker is provides an air channel connecting the back speaker to the other side of the PCB. The location of the aperture may be near or adjacent to the speaker. Providing a back cavity for a speaker may be used to reduce or eliminate an acoustic "short circuit" of the speaker between the front side and back side of the speaker. Additional enclosures may be provided for other speakers, such as for a speaker mounted on the top side of the PCB. The speaker may be mounted above the PCB and an enclosure may be provided directly underneath or beside same. Additionally or alternatively, the transducer may be a microphone.

Figure 3:
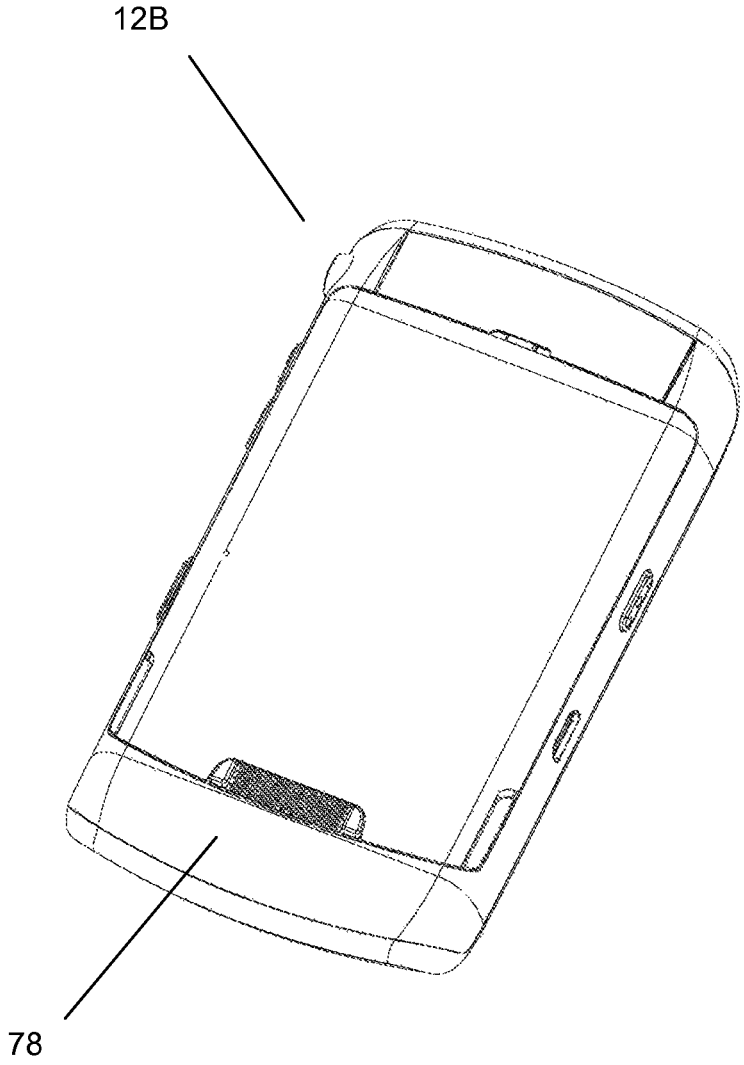
FIG. 3 is a rear perspective view of a back side of the device of FIG. 1.

FIGS. 3 to 10 provide further detail on aspects of an embodiment. Therein, housing 12 and internal components of device 10 are shown. For the purposes of illustration, references to front side, back side, left side, right side, and top and bottom ends are provided using the orientation markings relative to the side view of device 10 as shown in FIG. 3. Therein, the front side of PCB 76 described earlier is the front facing side having display 14 mounted thereto. It will be appreciated that the terms "top" and "upper" may be used interchangeably the "front" side and the "top" end of device 10 and similarly that the terms "bottom", "rear" and "lower" may be used interchangeably with the "back" side of device 10. The relative positions and directions will be clear in the context of the use of the terms. These references provide relative positional references for components for convenience only and are not meant to be limiting, unless otherwise noted.

Referring to FIG. 3, back side of housing 12B is shown. Therein opening 78 is provided which provides an opening for back speaker 16B. As such, acoustic signals generated by speaker 16B can emanate through opening 78. There is a removable back cover shown as being part of housing 12B.

Figure 4:
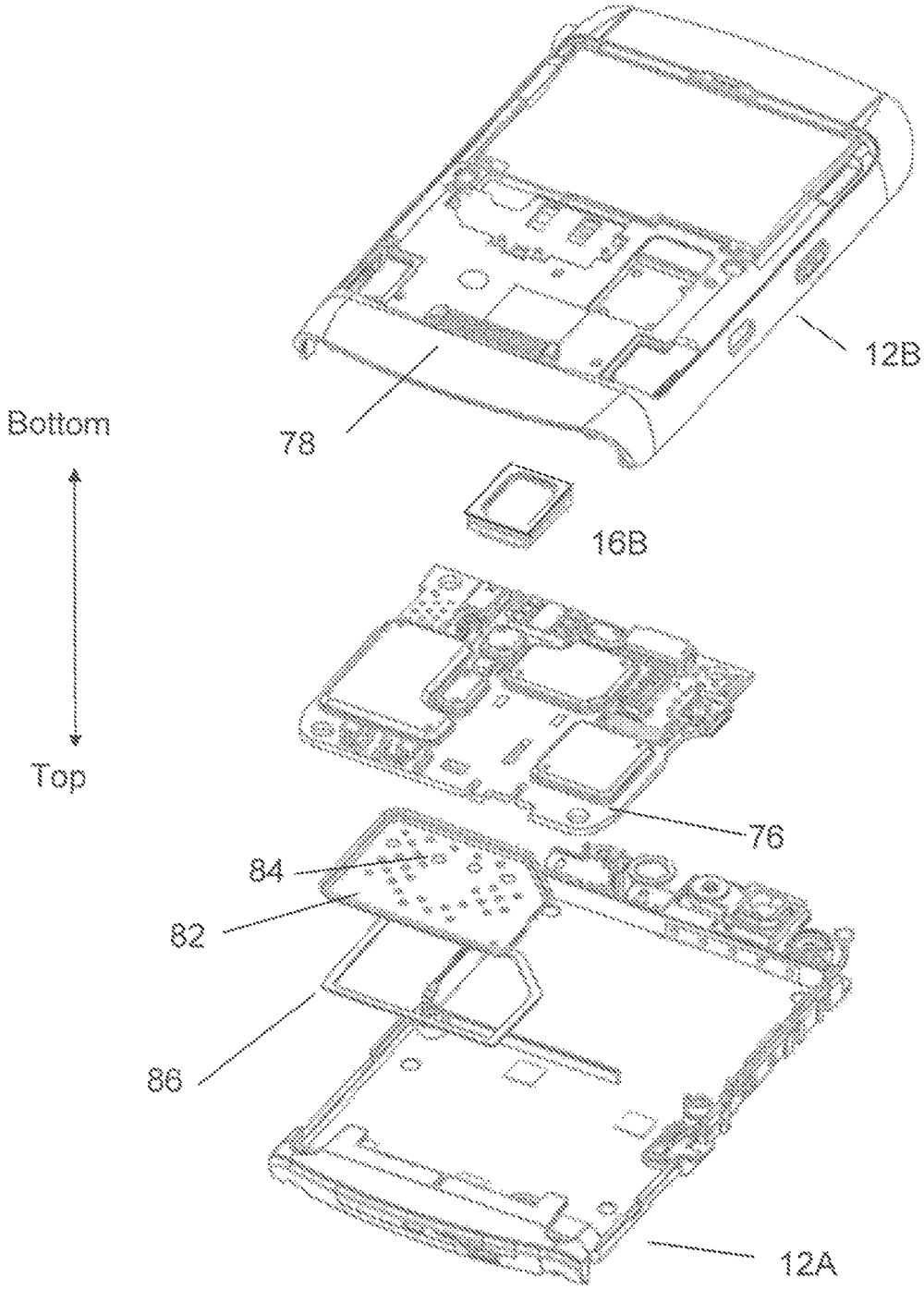
FIG. 4 is a rear perspective exploded view of the back side of the device of FIG. 1 with its internal components including the back speaker, its enclosure and the bottom side of a printed circuit board (PCB)
Figure 5:
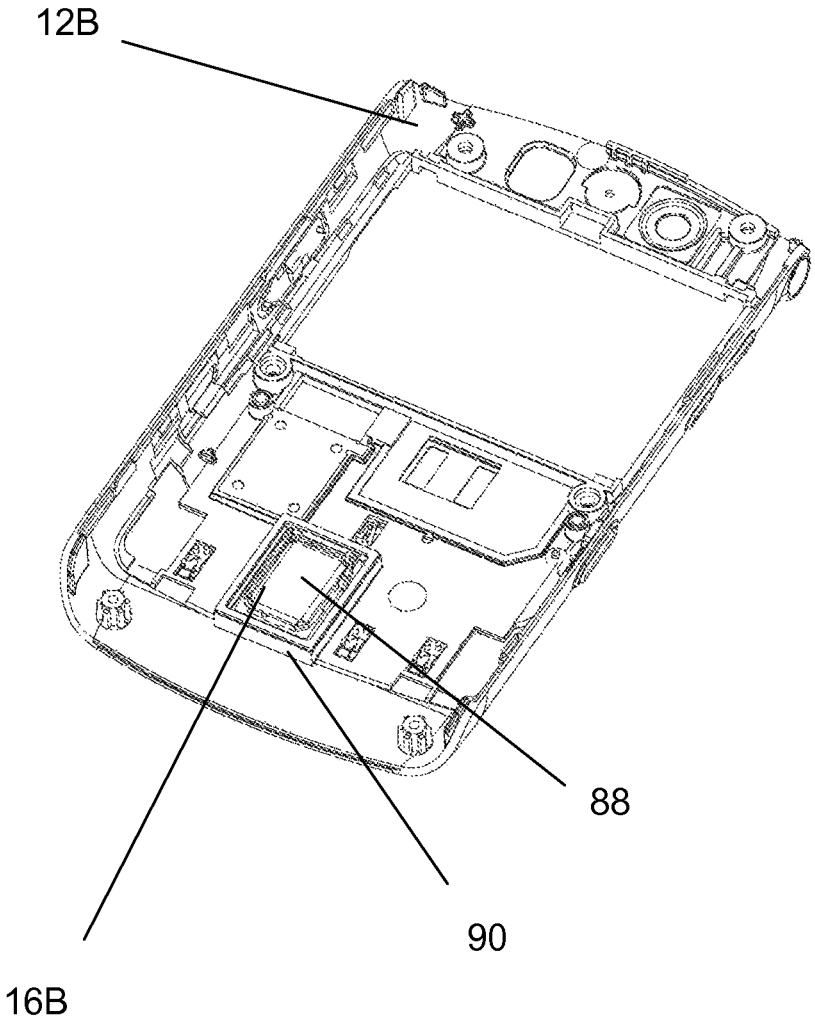
FIG. 5 is a perspective view of the inside of the back housing of the device of FIG. 1 with its back speaker.

Referring to FIGS. 4 and 5, internal components of device 10 are shown. Therein, back housing 12B has a mounting region 88 formed within the internal back side of housing 12B for receiving speaker 16B to place its diaphragm facing opening 78. When speaker 16B is mounted into mounting region 88 of housing 12B, it fits snugly therein. The removable back cover for housing 12B is not shown.

Referring to FIG. 5, when speaker 16B is mounted into housing 12B, it mates onto PCB 76 about area 700 (FIG. 7) as shown. There may be a volume of air defined by a space between the top side of speaker 16B and a part of mounting region 88 and the internal back side of housing 12B. Another volume of air is defined by the space defined by the bottom of speaker 16B (when mounted into housing 12B), walls of mounting region 88 and PCB 76. In one embodiment, this volume is about 0.2 $cm^3$. One or both of the volumes of air around speaker 16B may be used to tune acoustic properties of speaker 16B in addition to other cavities provided herein. In other embodiments, additional parts, walls, or barriers etc. may be provided to form mounting region 88.

On the top side of PCB 76, other components are provided. In an area that is directly opposite of the back side of PCB 76 with and area 700, radio frequency (RF) shield 82 is provided. As shown, for one embodiment apertures 84 are provided in the top side of RF shield 82 and gasket 86 is affixed to the top side of RF shield 82.

Referring to FIG. 5, back housing 12B is shown, with back speaker 16B mounted within a volume defined by mounting region 88. As shown, mounting region 88 is defined by a series of walls 90 which may be integrally formed within the underside of housing 12B. Walls 90 may form a hermetic or near hermetic seal when speaker 16B is mounted onto PCB 76. As shown, walls 90 are located to provide a snug fit for back speaker 16B within mounting region 88. Additionally or alternatively, apertures, ports and extensions may be provided extending from one of walls 90 to increase the volume associated with speaker 16B. This may be useful to provide different acoustic properties for speaker 16B.

Figure 6A:
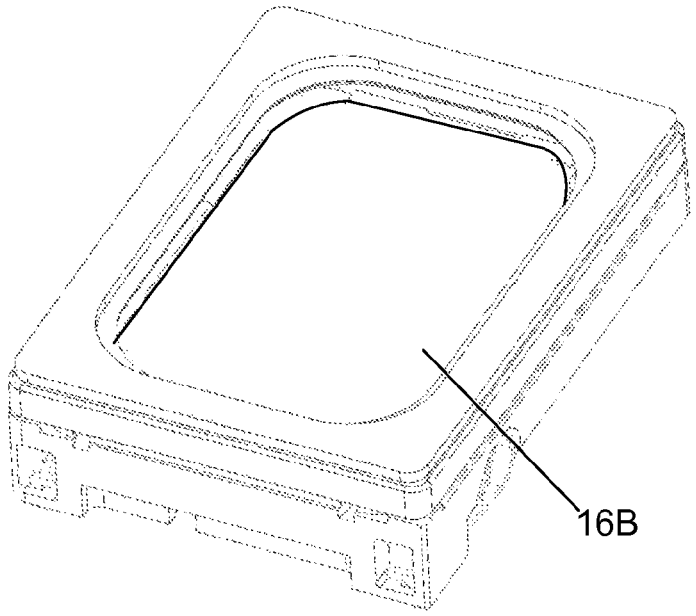
FIG. 6A is a top perspective view of the back speaker of FIG. 5.
Figure 6B:
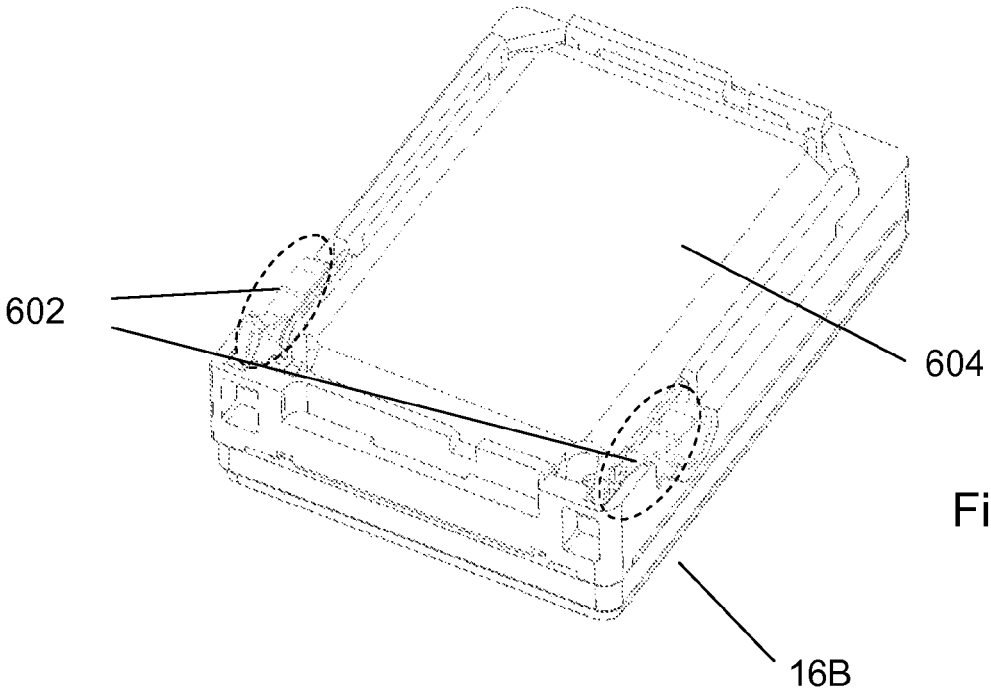
FIG. 6B is a bottom perspective view of the back speaker of FIG. 5.

Referring to FIGS. 6A and 6B, further features of speaker 16B are shown. In FIG. 6A, the top portion of speaker 16B is shown where surface 600 faces opening 78 of housing 12B. Sound is generated through surface 600 of speaker 16B. Referring to FIG. 6B, the bottom side of speaker 16B is shown where terminals 602 provide electrical contacts between internal components of speaker 16B and other circuits in device 10. A gasket may be provided around the perimeter of speaker 16B, such as around the edge of walls 90 (FIG. 5) to provide a compressible seal for speaker 16B when speaker 16B is mounted against PCB 76. Speaker 16B has a flat diaphragm, is a rectanguloid volume has a footprint of approximately 11 mm×15 mm on PCB 76. Components in device 10 provide and generate electrical signals for back speaker 16B, which when received by back speaker 16B are converted to acoustic signals per typical operation of a speaker. Other types and sizes of speakers may be used including speakers having cone diaphragms.

Figure 7:
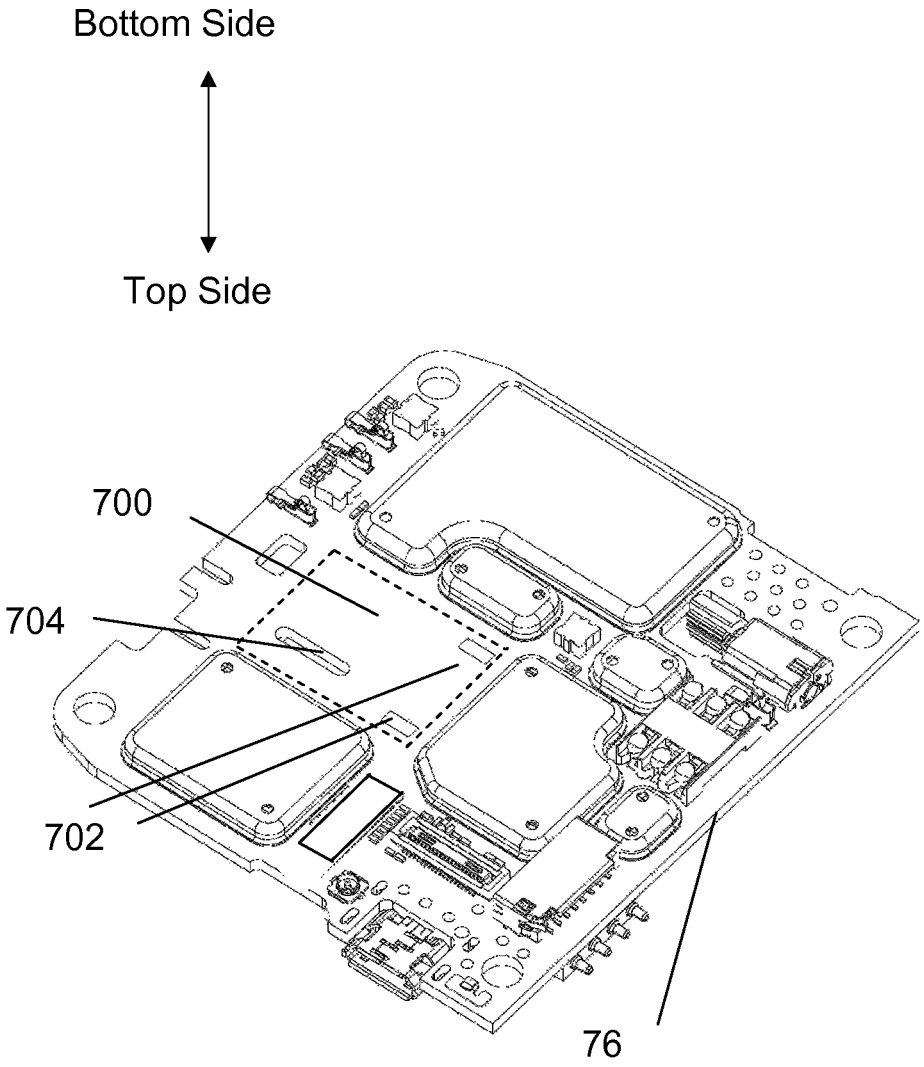
FIG. 7 is a rear perspective view of the bottom side of the PCB of FIG. 4 on which the bottom side of the back speaker mounts.

Referring to FIG. 7, a bottom portion of PCB 76 is shown where back speaker 16B mounts there against. This view of PCB 76 is rotated approximately 90 degrees clockwise from the view of FIG. 4. In particular, the rear portion of back speaker 16B in area 700 will press against PCB 76 (and will compress the gasket surrounding speaker 16B) when device 10 is fully assembled. When device 10 is assembled, speaker 16B is mounted in housing 12B, PCB 76 populated with its components and is encapsulated within housing 12A and housing 12B.

Contact pads 702 of PCB 76 provide electrical contacts for terminals 602 (FIG. 6B) of back speaker 16B. As such, a volume around speaker 16B is defined by walls 90, back housing 12B and PCB 76.

One or more openings may be provided in a generally closed volume for speaker 16B. One opening is the opening 78 on housing 12B. Another opening is aperture 704, which is provided within region 700. Aperture 704 is located within region 700 on PCB 76, which is the footprint of speaker 16B, so that speaker 16B covers at least part of aperture 704 when speaker 16B is mated to region 700. As such, aperture 704 also bounded above by mounting region 88. Aperture 704 provides an air channel for speaker 16B to the other side (namely the top side) of PCB 76. As such speaker 16B is in air communication with the top side of PCB 76 through aperture 704. As shown in FIG. 7, aperture 704 is generally rectangular with rounded ends; the cross-sectional size of aperture 704 is about 10 $mm^2$, but other locations, sizes and shapes may also be desirable. The location, overall cross-section size and shape of aperture 704 can be changed to tune a resonance frequency for the back cavity. In one embodiment, the resonance is tuned to be outside the typical operating range of speaker 16B. As such, the resonance may be tuned to be outside the range of about 300 Hz to 3,300 Hz (or more). In one design embodiment, it is desirable to have an aperture located near the back side of the speaker output. The size of the aperture may depend on the size of the back and/or front speaker cavities. In other embodiments, other shapes and sizes may be provided. The location may also be changed; in other embodiments aperture 704 fully covers by speaker 16B when speaker 16B is mated to region 700. In other embodiments, aperture 704 may be located beside the footprint of speaker 16B, but still within the space on PCB 76 bounded by mounting region 88. In yet other embodiments part or all of aperture 704 may be located outside of region 700 and/or the footprint of mounting region 88 on PCB 76. There may be additional apertures, holes or slots provided in PCB 76 or in walls 90. One or more of such additional apertures may (or may not) be in air communication with the interior volume of RF shield 82. For example, the collective cross-section area of the apertures may be between 0.1 $mm^2$ and 20 $mm^2$. Acoustic mesh may or may not be provided over aperture 704. Aperture 704 in PCB 76 may be formed using any of several manufacturing/forming techniques, such as drilling, punching, burning, molding and etching same on PCB 76. Automated systems, such as computer numerical control (CNC) systems may be used to provide aperture 704 on PCB 76. In other embodiments, speaker 16B may be provided with an air connection to the opposite side of PCB 76 through a conduit, hose or channel. Additionally or alternatively, speaker 16B may be located about an edge of PCB 76 so that a part of it extends over the edge and an enclosure is in (air) communication with the part of speaker 16B that is over the edge. Additionally, a separate tube or conduit may be provided that is inserted into one or more of the apertures, where each open end of the tube communicates with its immediately surrounding volume of air.

Figure 8A:
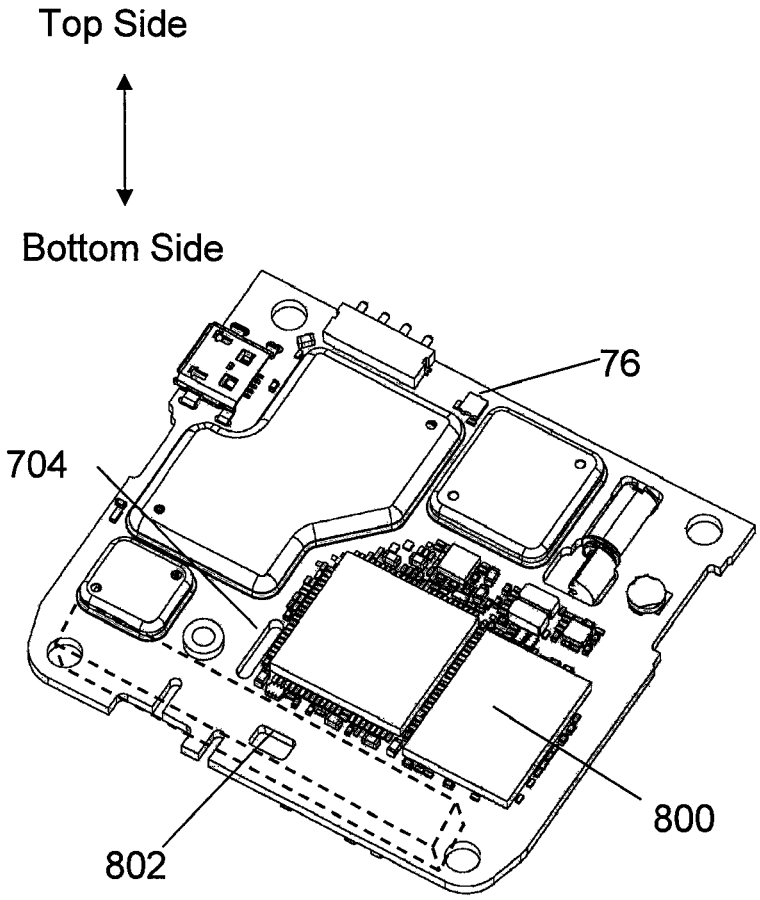
FIG. 8A is a front perspective view of a top side of the PCB of the device of FIG. 1 with top components mounted thereon.
Figure 8B:
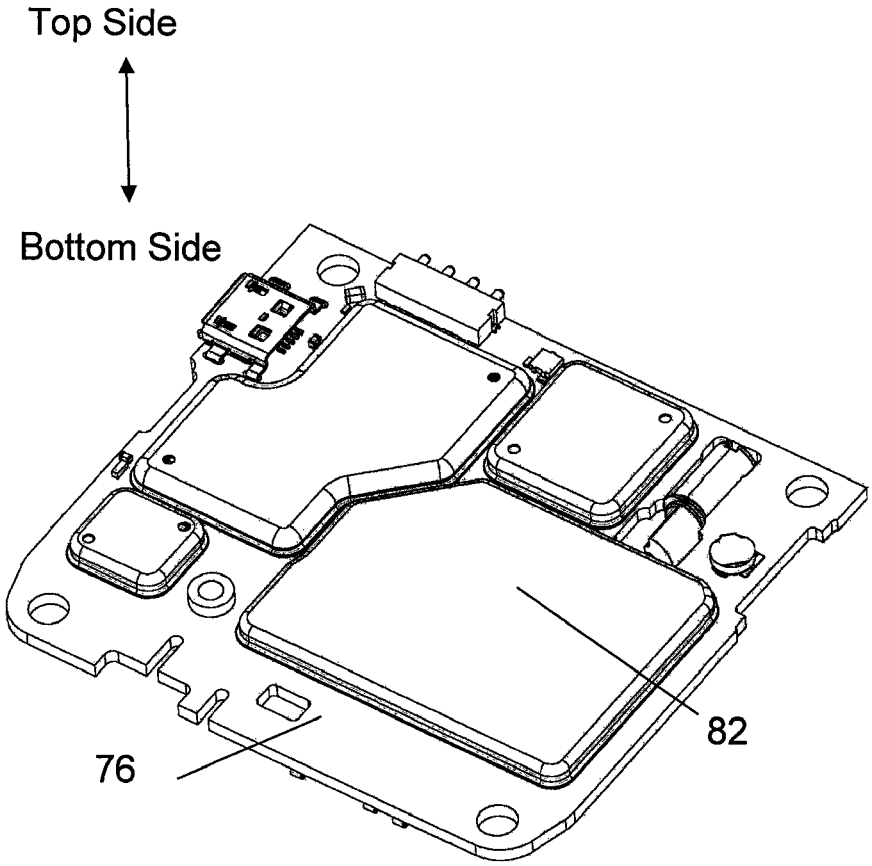
FIG. 8B is a front perspective view of the top side of the PCB of FIG. 8A with a radio frequency (RF) shield mounted over selected top components.

Referring to FIGS. 8A and 8B, top side of PCB 76 is shown. This view of PCB 76 is rotated approximately 90 degrees counter-clockwise from the view of FIG. 7. Aperture 704 provides an air channel from the bottom side to the top side of PCB 76. As such, through aperture 704, a volume of air on the top side of PCB 76 around aperture 704 can communicate (i.e. can be in air contact) with a volume of air on the bottom side of PCB 76 around aperture 704. A volume of air is captured between RF shield 82 and the top side of PCB 76. This volume is connected to back speaker 16B through aperture 704. This additional volume provides enhanced acoustic characteristics for speaker 16B, such as reducing back-wave noise. For a given speaker, the volume of the enclosure affects the performance characteristics of the enclosure. In one embodiment, a volume of about 1 $cm^3$ is desired for a back cavity. However, a range of between about 0.3 $cm^3$ and 5.0 $cm^3$ or more may be provided in other embodiments. In one embodiment, RF shield 82 provides a volume of approximately 0.78 $cm^3$ of space as an acoustic enclosure for the back of speaker 16B. RF shield 82 may be affixed onto PCB 76 by soldering it to PCB 76, or it may be affixed via screws or other mechanical securing or fitting mechanisms, including a press fit against PCB 76 from housing 12.

Devices 800 are located on the top side of PCB 76. One or more selected devices 800 are sensitive electronic components which require shielding from external RF signals. Some RF signals may be generated by antennae 54 and 56. Antennae 54 and 56 may be housed in an antenna enclosure (not shown) but identified generally at outline 802. In order to shield one or more devices 800 from radio frequency signals from antennae 54 and 56 in region 802, RF shield 82 is provided. When provided, RF shield 82 mounts over one or more selected devices 800 and encloses aperture 704. RF shield 82 has a perimeter and shape that is slightly larger than the devices 800 that it encloses. However, in other embodiments, other shapes may be provided depending on the available space on PCB 76. RF shield 82 may be a metallic component to provide shielding for its components contained within. RF shield 82 may be formed from a stamped piece of metal; it may be a plastic component with metallic paint or coating applied thereto. There may be a gasket (not shown) provided along the bottom of shield 82 between the bottom edge of shield 82 and PCB 76. There may be an electrical contact provided between shield 82 and a ground plane on PCB 76. In an embodiment, the RF shielding capabilities of shield 82 do not necessarily apply to speaker 16B. However, in certain embodiments RF shield 82 may provide such shielding to speaker 16B. In other embodiments, RF shield 82 may be replaced with a non-shielding cap. There may or may not be components located underneath the cap.

Figure 9:
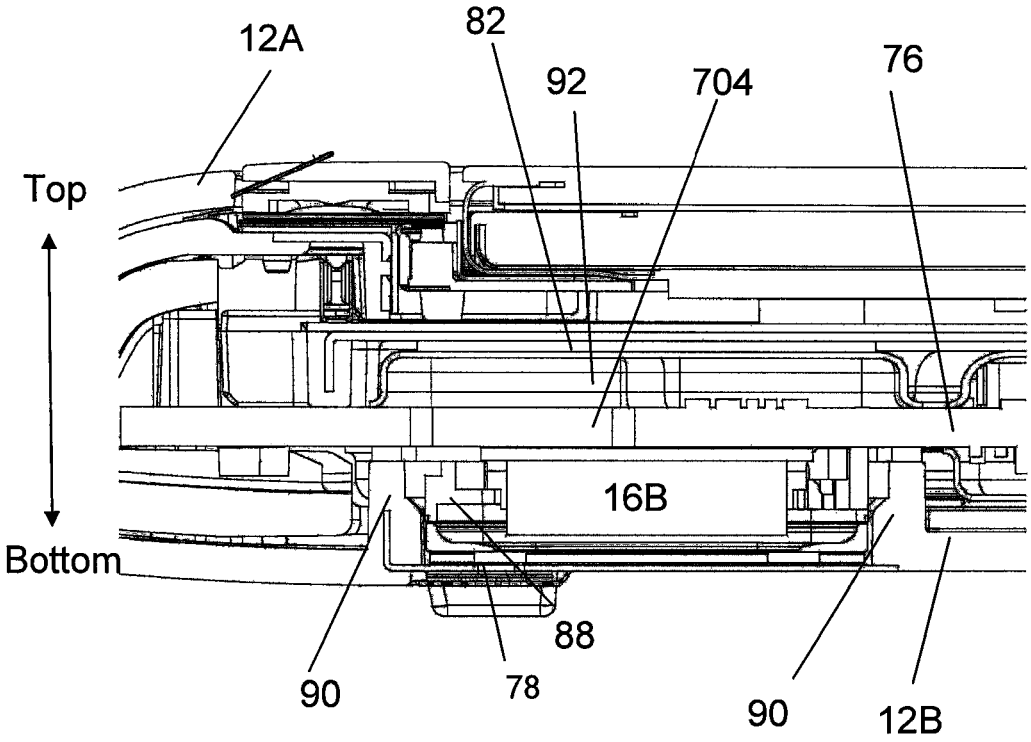
FIG. 9 is a side cross-sectional view of the device, its housing, back speaker, PCB and other components of FIG. 1.

Referring to FIG. 9, a side cross-sectional view of a section of device 10 showing selected components when device 10 is fully assembled, where the top and bottom of device 10 is as shown. The upper part of device 10 (namely where display 14 is located) is on the right side of FIG. 9. As shown, housing 12A mates with housing 12B thereby sandwiching speaker 16B within its mounting region 88 against the bottom side of PCB 76. Aperture 704 provides an air channel for speaker 16B to the top side of PCB 76 and the volume of air 92 enclosed within PCB 76 bounded by RF shield 82. As shown, RF shield 82 is located directly underneath speaker 16B. In other embodiments, an enclosure may not be directly underneath speaker 16B. For example, it may be partially underneath speaker 16B (whether above or below PCB 76) and/or a portion of the enclosure may be beside speaker 16B on the same side of PCB 76 and/or a portion of the enclosure may be offset from speaker 16B on the opposing side of PCB 76. In one embodiment, as long as the aperture provides an acoustic connection from the volume of air about speaker 16B to a volume of air located on the opposite side of PCB 76, the aperture may be of any suitable size and may be located in any available location on PCB 76. There may be other physical or performance criteria for other components that affect the location and/or size of the aperture(s).

Figure 10:
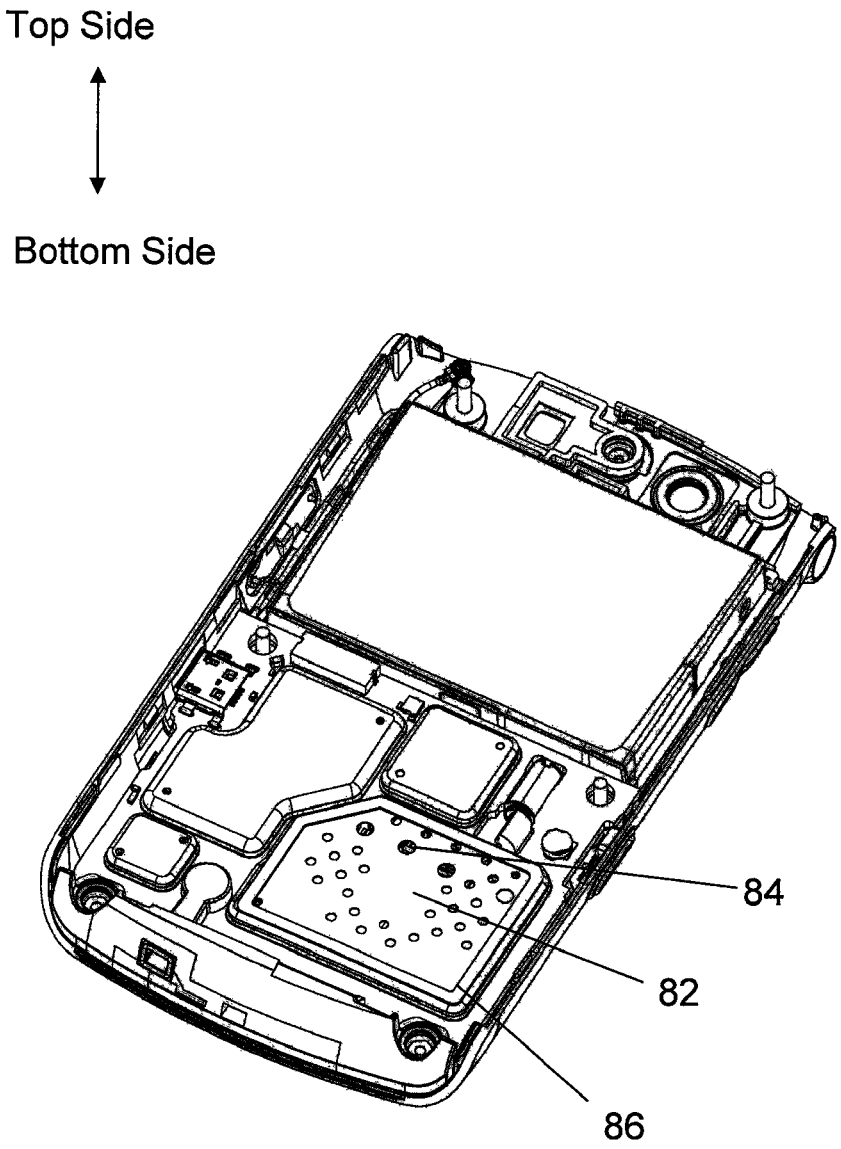
FIG. 10 a front perspective view of a block diagram of an alternative RF shield provided on the top side of the PCB of FIG. 8B.

Using FIGS. 4, 9 and 10 as examples, in a further embodiment, RF shield 82 may be sized to provide additional acoustic shaping properties for speaker 16B. In some embodiments, the size of RF shield 82 may be constrained. As such, as an extension to shield 82 for its acoustic properties for speaker 16B, a series of apertures 84 may be provided on the top surface of RF shield 82 and (compressible) gasket 86 may be provided around a top perimeter of the RF shield 82. Gasket 86 may have a sufficient height to interface with the interior face of housing 12A. As such, the volume of air that is accessed by back speaker 16B is increased by the volume within the top section of shield 82 bounded by gasket 86 and the interfacing surface of the interior of housing 12A.

In other embodiments other air channels may be provided and other enclosures may be provided for speaker 16B (or other speakers). For example, aperture 704 may connect to an open volume of air above the top surface of PCB 76 that has no enclosure. Additionally and/or alternatively, an enclosure or a part thereof that is in air communication with aperture 704 may be formed by a feature of top portion housing 12A. Additionally or alternatively, a further conduit may be provided from aperture 704 to an additional enclosure, such as an enclosure for antenna 54 and/or 56 may be accessed, as shown by volume 800. Also, another enclosure may be provided for speaker 16B that is located on the same side of PCB 76 as speaker 16B.

Another embodiment is shown in FIG. 10, where RF shield 82B is shown. As noted above, RF shield 82 provides approximately 0.78 $cm^3$ of volume in its enclosure. In certain implementations, a larger volume of air for an enclosure for speaker 16B may be provided. However, in some component configurations for device 10, it may not be possible to replace RF shield with a larger shield to increase the volume of air for its enclosure. As such, an enclosure extension providing a second volume of air is provided, in the form of RF shield 82B. Dimensionally and structurally, RF shield 82B may be the same or similar to shield 82B. An enclosure extension is provided on the top of RF shield 82B. Air access from the first volume of air within RF shield 82B to the enclosure extension is provided with holes 84 in the top surface of RF shield 82B. Gasket 86 is placed on the top of RF shield 82B around its top perimeter (namely on the surface of RF shield 82B that is closest to the front side of device 10), enclosing holes 84. Gasket 86 may be provided with sufficient height such that it creates a seal between the top part of RF shield 82B and the interior face of housing 12A. The enclosure extension is formed by the top surface of RF shield 82B, the interior volume within gasket 86 and the interior face of housing 12A capturing a second volume of air that is in air communication with the first volume of air and is used with the first volume of air to tune the operating characteristics of speaker 16B. There may be a formation, such as a set of ridges or walls on the interior face of housing 12A that mates with gasket 86 when device 10 is assembled to form the enclosure extension. In the embodiment, the enclosure extension provides approximately about 0.22 $cm^3$ of additional space for the back cavity for speaker 16B. In other embodiments, the size of the enclosure extension may range between about 0.05 $cm^3$ and 0.75 $cm^3$. It will be appreciated that other dimensions may be used. Additionally or alternatively a cap may be secured to gasket 86 to create the enclosure extension connected to the interior of shield 82B. The cap may be flat or it may be shaped to have a set of walls and a top to provide the external boundaries of the enclosure extension.

In other embodiments, an enclosure for a speaker may be provided on the same side of the PCB on which the speaker mounts, incorporating any one or more of the enclosure features, apertures or other acoustic properties described above.

It will be appreciated that one benefit of an embodiment is that an enclosure, such as an RF shield, provides RF shielding to its enclosed components and an enclosed volume that is useful for tuning acoustic properties of a transducer. This provides a reduced part count, as a separate enclosure for the transducer is not needed. It also provides an efficient real estate layout for component on the substrate of device 10.

It will be appreciated that the embodiments relating to devices, modules, applications and systems may be implemented in a combination of electronic hardware, firmware and software. The firmware and software may be implemented as a series of processes and/or modules that provide the functionalities described herein. Interrupt routines may be used. Data may be stored in volatile and non-volatile devices described herein and be updated by the hardware, firmware and/or software. Some of the processes may be distributed. The physical components providing structural support for the elements described herein (such as the housing and its internal structures) may be formed from materials known to those in the art using processes known to those in the art.

In other embodiments, an embodiment may provide an enclosure for other transducers, such as receivers, such as microphones. Further the enclosure may adjust response characteristics of received signals.

As used herein, the wording "and/or" is intended to represent an inclusive-or. That is, "X and/or Y" is intended to mean X or Y or both.

In this disclosure, where a dimension is provided as an approximate value (for example, when the dimension is qualified with the word "about"), a range of values will be understood to be valid for that dimension. For example, for a dimension stated as an approximate value, a range of about 20% larger and 20% smaller than the stated value may be used. Dimensions of features are illustrative of embodiments and are not limiting unless noted.

The present disclosure is defined by the claims appended hereto, with the foregoing description being merely illustrative of an embodiment of the present disclosure. Those of ordinary skill may envisage certain modifications to the foregoing embodiments which, although not explicitly discussed herein, do not depart from the scope of the present disclosure, as defined by the appended claims.

The invention claimed is:

1. A system comprising:
a substrate having
a first side with a speaker mounted on the first side,
a second side opposite the first side, and
a first aperture providing an opening from the first side to the second side of the substrate;
a component mounted on the second side of the substrate opposite the speaker; and
an enclosure
affixed to the substrate on the second side; and
covering and providing a radio frequency 'RF' shield for the component on the second side of the substrate,
wherein a first volume is defined by an interior space defined by the enclosure, the component and the second side of the substrate.

2. The system as claimed in claim 1, further comprising:
a gasket located on a top of the enclosure; and
a second aperture on a top surface of the enclosure,
wherein the enclosure, the gasket and the top of the enclosure define a second volume connected to the first volume by the second aperture.

3. The system as claimed in claim 2, wherein the second volume is between 0.05 $cm^3$ and 0.75 $cm^3$.

4. The system as claimed in claim 1, further comprising:
a gasket located on a top of the enclosure;
a cap for the gasket; and
a second aperture on a top surface of the enclosure,
wherein the cap, the gasket and the top of the enclosure define a second volume connected to the first volume by the second aperture.

5. The system as claimed in claim 1, wherein the housing further comprises a mounting region extending from an internal surface to hold the speaker.

6. The system as claimed in claim 1, wherein the speaker is a back speaker projecting sound from a back side of the electronic device.

7. The system as claimed in claim 6, wherein the first volume is between 0.3 $cm^3$ and 5.0 $cm^3$.

8. The system as claimed in claim 1, wherein the first aperture has a cross-sectional area of between 0.1 mm2 and 20 mm2 on the substrate.

9. The system as claimed in claim 1, further comprising a tube inserted into the first aperture.

10. The system as claimed in claim 1, wherein:
the enclosure encloses an antenna for an electronic device.

11. An electronic device, comprising:
a housing;
a substrate having
a first side with a speaker mounted on the first side,
a second side opposite the first side, and
a first aperture providing an opening from the first side to the second side of the substrate;
the speaker making an electrical connection with the first side of the substrate;
a component mounted on the second side of the substrate opposite the speaker; and
an enclosure
affixed to the substrate on the second side; and
covering and providing a radio frequency 'RF' shield for the component on the second side of the substrate,
wherein
the substrate, the speaker and the enclosure are contained within the housing; and
a first volume is defined by an interior space defined by the enclosure, the component and the second side of the substrate.

12. The electronic device as claimed in claim 11, further comprising:
a second speaker,
wherein the speaker is a back speaker projecting sound from a back side of the electronic device.

13. The electronic device as claimed in claim 11, further comprising:
a gasket located on a top of the enclosure; and
a second aperture on a top surface of the enclosure,
wherein the housing, the gasket and the top of the enclosure define a second volume connected to the first volume by the second aperture.

14. The electronic device as claimed in claim 11, wherein the housing further comprises a mounting region extending from an internal surface to hold the speaker.

15. The electronic device as claimed in claim 11, wherein the first volume is between 0.3 $cm^3$ and 5.0 $cm^3$.

16. The electronic device as claimed in claim 11, wherein the first aperture has a cross-sectional area of between 0.1 mm2 and 20 mm2 on the substrate.

17. A method comprising:

forming an aperture in a substrate, the substrate having a first side and a second side opposite the first side;

mounting a speaker to the first side of the substrate proximate to the aperture;

mounting a component on the second side of the substrate opposite the speaker; and mounting an enclosure to the second side of the substrate such that the enclosure covers the aperture and the component, wherein the enclosure defines a first volume by an interior space of the enclosure, the component and the second side of the substrate, and the speaker is in air communication with the first volume through the aperture.

18. The system as claimed in claim 1, wherein:

the component is an electrical component; and the substrate is a printed circuit board (PCB) providing an electrical connection to the component.

* * * * *